US008992054B1

(12) United States Patent
Grollmus

(10) Patent No.: US 8,992,054 B1
(45) Date of Patent: Mar. 31, 2015

(54) PROVIDING A LAMPSHADE WITH A LONGITUDINAL SLIT TO RECEIVE A LAMPSHADE COVER

(76) Inventor: Laura Grollmus, San Francisco, CA (US)

( * ) Notice: Subject to any disclaimer, the term of this patent is extended or adjusted under 35 U.S.C. 154(b) by 273 days.

(21) Appl. No.: 13/345,634

(22) Filed: Jan. 6, 2012

(51) Int. Cl.
*F21V 11/00* (2006.01)
*F21V 1/12* (2006.01)

(52) U.S. Cl.
CPC ..... *F21V 1/12* (2013.01); *Y10S 362/806* (2013.01)
USPC ..... 362/351; 362/357; 362/358; 362/458; 362/806; 362/352

(58) Field of Classification Search
USPC ..... 362/351, 352, 357, 358, 457, 458, 806
See application file for complete search history.

(56) References Cited

U.S. PATENT DOCUMENTS

| | | | |
|---|---|---|---|
| 2,593,272 | A | 4/1952 | Cohon |
| 4,212,052 | A | 7/1980 | Chambard |
| 4,731,715 | A | 3/1988 | Anderson |
| 5,211,474 | A | 5/1993 | Leitner et al. |
| 5,532,912 | A | 7/1996 | Bendit |
| 5,662,412 | A | 9/1997 | Glendmyer |
| 2009/0196051 | A1 | 8/2009 | Dick et al. |

OTHER PUBLICATIONS

Hatashita-Lee, Kathryn. "Types of Fasteners for Clothing," eHow.com. eHow, Apr. 25, 2011. (6 pages) Web Dec. 27, 2011.<http://www.ehow.com/info_8295011_types-fasteners-clothing.html>.
Stone, Abby. "How to Determine the Right Lampshade for a Lamp," apartmenttherapy.com. ApartmentTherapy, Jan. 18, 2011. (2 pages) Web Dec. 27, 2011. <http://apartmenttherapy.com/la/diy/how-to-figure-out-the-right-lampshade-for-your-lamp-136342>.
Harris, Pamela Cole. "Six Lamp Shade Shapes," About.com. (3 pages) Web Dec. 27, 2011. <http:// budgetdecorating.about.com/od/changingaccessories/ss/Shade-Shapes.htm>.

*Primary Examiner* — Anh Mai
*Assistant Examiner* — Meghan Dunwiddie
(74) *Attorney, Agent, or Firm* — Carr & Ferrell LLP

(57) ABSTRACT

A lampshade is provided with a longitudinal slit to receive a lampshade cover. According to one embodiment of the present invention, the lampshade includes an external surface and an internal surface. At least one fastener is affixed to an internal surface of the lampshade. The lampshade also includes at least one longitudinal slit on its outer surface. The longitudinal slit is configured to receive both ends of at least one lampshade cover. The lampshade cover includes decoration on an external surface. At least one fastener is affixed to an internal surface of the cover. A further embodiment of the present invention utilizes a method of applying a lampshade cover to a lampshade.

19 Claims, 4 Drawing Sheets

PROVIDING A LAMPSHADE WITH A LONGITUDINAL SLIT TO RECEIVE A LAMPSHADE COVER

BACKGROUND

Field of the Invention

The present invention relates generally to light fixtures, and more particularly to lampshades.

SUMMARY

A lampshade is provided with a longitudinal slit to receive a lampshade cover. According to one embodiment of the present invention, the lampshade includes an external surface and an internal surface. At least one fastener is affixed to an internal surface of the lampshade. The lampshade also includes at least one longitudinal slit on its outer surface. The longitudinal slit is configured to receive both ends of at least one lampshade cover.

The lampshade cover includes decoration on an external surface. At least one fastener is affixed to an internal surface of the cover.

A further embodiment of the present invention utilizes a method of applying a lampshade cover to a lampshade.

DETAILED DESCRIPTION

A lampshade is a fixture that covers the light bulb on a lamp. The main purpose of a lampshade is to diffuse the light that the light bulb emits. Beyond its practical purpose, significant emphasis is usually given to the lampshade's decorative and aesthetic features. As such, a homeowner may choose to coordinate her lampshade with other room furnishings, such as curtains and tablecloth. In addition, a lampshade may become discolored or outdated with normal usage and the passing of time, which may cause the homeowner to replace the lampshade. Although there is a wide array of lampshades of different colors and styles available for purchase, purchasing multiple lampshades may be prohibitively expensive.

The lampshade with a longitudinal slit to receive a lampshade cover, the lampshade cover itself, and the method for applying the lampshade cover to the lampshade may allow a homeowner to coordinate her lampshade with her room furnishings or to "freshen up" her discolored or outdated lampshade at a relatively low cost. The present invention may allow for the purchase of one lampshade and may provide numerous design and styling opportunities with the use of inexpensive decorative covers. These decorative covers may be reused or disposed by the homeowner at her convenience.

The lampshade with a longitudinal slit to receive a lampshade cover, the lampshade cover itself, and the method for applying the lampshade cover to the lampshade may also allow for an elegant and sleek look to the lampshade and its decorative cover. With the insertion of the ends of the cover into a longitudinal slit on or in close proximity to the seam of the lampshade, the lampshade may maintain a smooth appearance, despite the fact that it is encircled by a decorative cover.

A lampshade with a longitudinal slit that receives a lampshade cover may be used to change the physical appearance of the lampshade without having to replace the lampshade itself. The lampshade cover may be easily removed from the longitudinal slit of the lampshade to wash or dry clean. The lampshade cover may be easily placed back on the lampshade by placing at least one of its ends through the longitudinal slit and attaching at least one of its fasteners to the corresponding fastener on the internal surface of the lampshade. The first end of the lampshade cover and the second end of the lampshade cover may then be attached to the internal surface of the lampshade. Alternatively, the lampshade cover may be disposed of, and a second lampshade cover may be placed on the lampshade.

Figure 1:
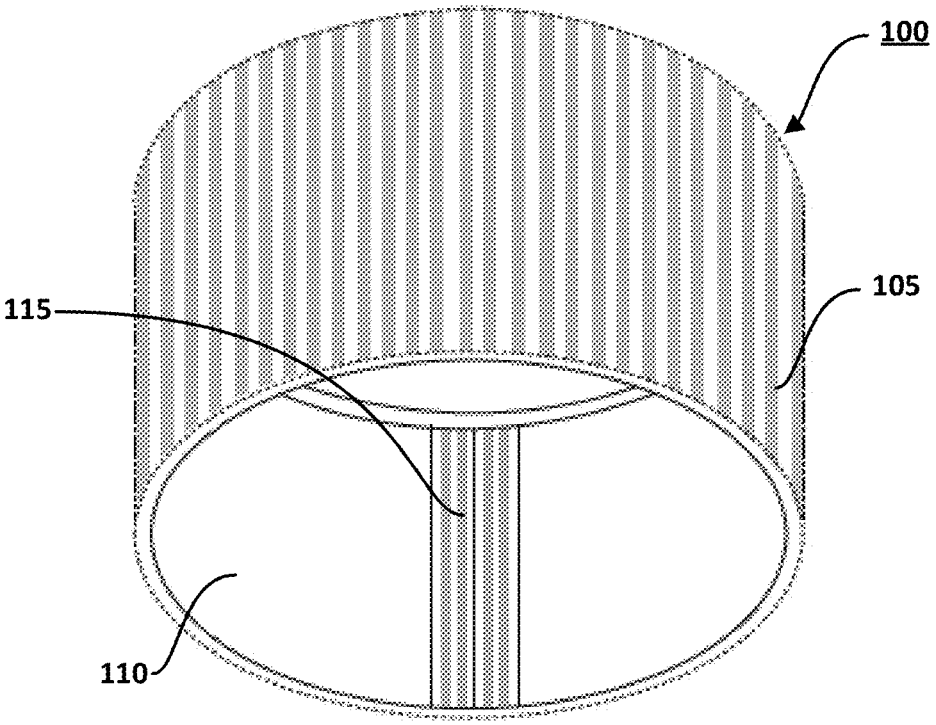
FIG. 1 is a diagram showing an embodiment of the lampshade and the lampshade cover, depicting both ends of the lampshade cover entered through the longitudinal slit in the lampshade and fastened to the internal surface of the lampshade.
Figure 2:
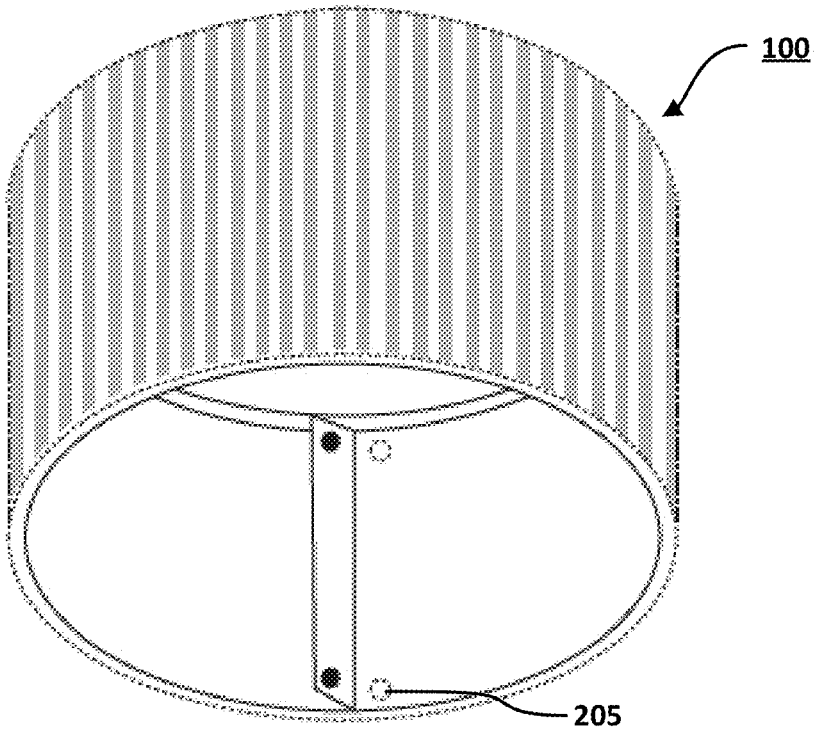
FIG. 2 is a diagram showing an embodiment of the lampshade, depicting one end of the lampshade cover unfastened to the internal surface of the lampshade.
Figure 3:
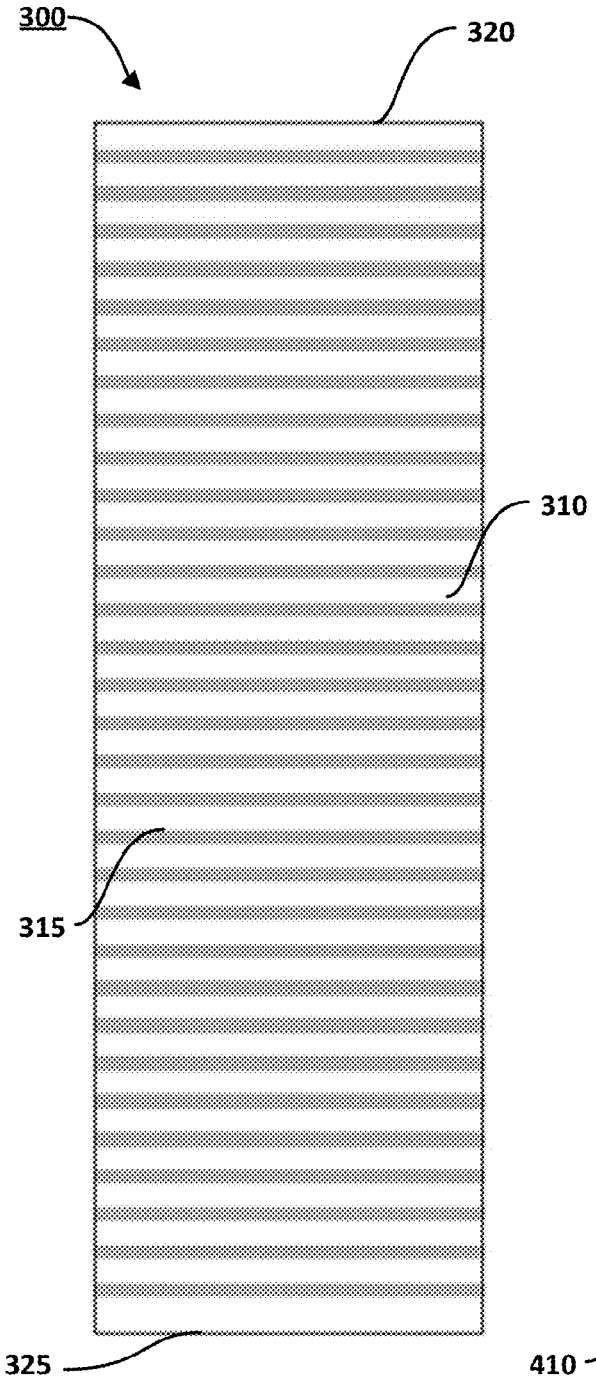
FIG. 3 is a diagram showing an embodiment of the lampshade cover, depicting the external surface of the lampshade cover.

A lampshade 100 and a lampshade cover 300 according to embodiments of the present invention are illustrated in FIGS. 1-3. As depicted in FIGS. 1 and 2, the lampshade 100 includes an external surface 105 and an internal surface 110. The external surface 105 and the internal surface 110 may also be composed of fire-resistant or fire-retardant material.

Referring first to FIG. 1, the lampshade 100 may be composed of any material, such as plastic, fabric, metal, and paper. The lampshade 100 may also be composed of or coated with fire-resistant or fire-retardant material. Additionally, the lampshade 100 may be of any size and of any shape, such as coolie, empire, bell, oval, and drum.

As depicted in FIG. 2., at least one fastener, a fastener 205, is attached to the internal surface 110. The fastener 205 is attached to the internal surface 110 with the use of any attachment procedure, such as sewing, gluing, or using magnets. The fastener 205 may be of any type of fastener, such as hook-and-loop, magnet, grommet, hook-and-eye, snap, fastener tape, and toggle.

Figure 5:
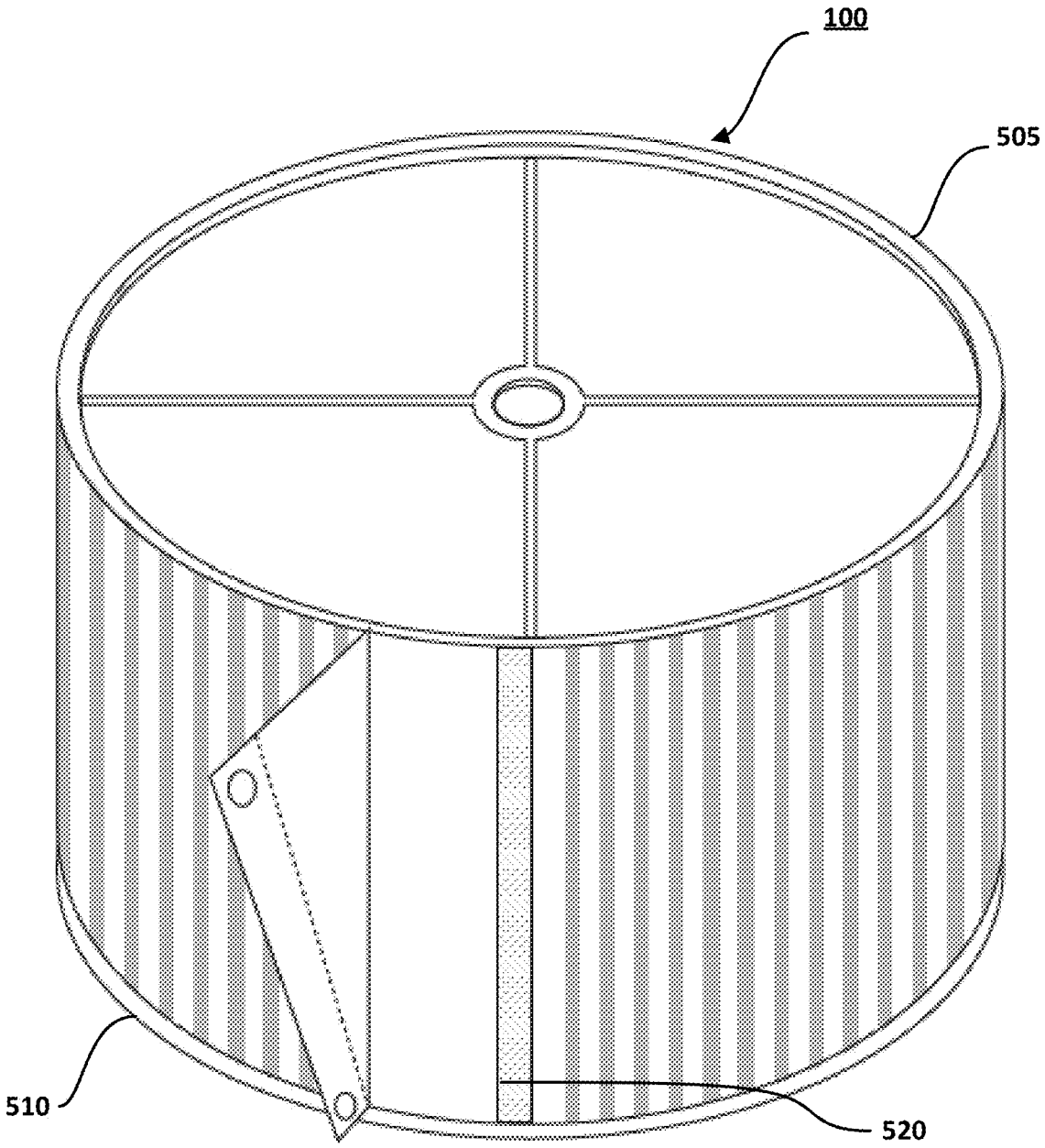
FIG. 5 is a diagram showing an embodiment of the lampshade, depicting the binding on one of the edges of the lampshade created by the longitudinal slit in the lampshade.

Turning now to the exemplary embodiment in FIG. 5, an upper seam binding 505 may line the top rim of the lampshade 100. In the exemplary embodiment, a lower seam binding 510 may line the bottom rim of the lampshade 100. The upper seam binding 505 and the lower seam binding 510 of the exemplary embodiment may provide the lampshade 100 with a finished look. As such, the upper seam binding 505 and the lower seam binding 510 may be decorative and may be of any color or design. The upper seam binding 505 and the lower seam binding 510 may also be composed of any material, such as rayon, silk, and cotton. In some embodiments, the placement of the upper seam binding 505 and the lower seam binding 510 on the respective upper and bottom rims of the lampshade 100 may reduce or prevent injury to the person who is handling the lampshade 100. For further safety purposes, the upper seam binding 505 and the lower seam binding 510 may be composed of or coated with fire-resistant or fire-retardant material.

Referring back to FIG. 1, the lampshade 100 includes a longitudinal slit 115. The longitudinal slit 115 is on the external surface 105 of the lampshade 100 and is configured to receive at least one end of the lampshade cover 300. In additional embodiments, the longitudinal slit 115 may be on or in close proximity to the seam of the lampshade 100. If made with two or more layers or pieces of material, the lampshade 100 may have a seam. The seam is the join where two or more layers of material are held or attached together. Placing the longitudinal slit 115 on the seam of the lampshade 100 may support and may protect the structural integrity of both the longitudinal slit 115 and the lampshade 100. In other embodiments, in which the lampshade is made with one piece of material and is therefore seamless, the longitudinal slit 115 may be placed anywhere on the external surface 105 of the lampshade 100.

The longitudinal slit 115 may extend along the full length of the external surface 105 of the lampshade 100. The full length of external surface 105 of the lampshade 100 is the full height of the lampshade 100, from the top of the lampshade 100 to the bottom of the lampshade 100. Alternatively, the longitudinal slit 115 may extend along the partial length of the external surface 105 of the lampshade 100. The partial length of the external surface 105 of the lampshade 100 is a fraction of the height of the lampshade 100 (e.g., one-half or three-quarters of the height of the lampshade 100).

As seen in the exemplary embodiment shown in FIG. 5., the longitudinal slit 115 may commence at the bottom of the upper seam binding 505 and may end at the top of the lower seam binding 510. Further, a longitudinal slit edge 520 may be created by the longitudinal slit 115 and may be lined with seam binding. Lining the longitudinal slit edge 520 with seam binding may reduce or may prevent injury to a person who may handle the lampshade 100 (e.g, a person who is putting at least one of the ends of the lampshade cover 300 through the longitudinal slit 115). As such, the seam binding may be composed of any material, such as rayon, silk, and cotton. The seam binding may also be composed of or coated with fire-resistant or fire-retardant material.

Figure 4:
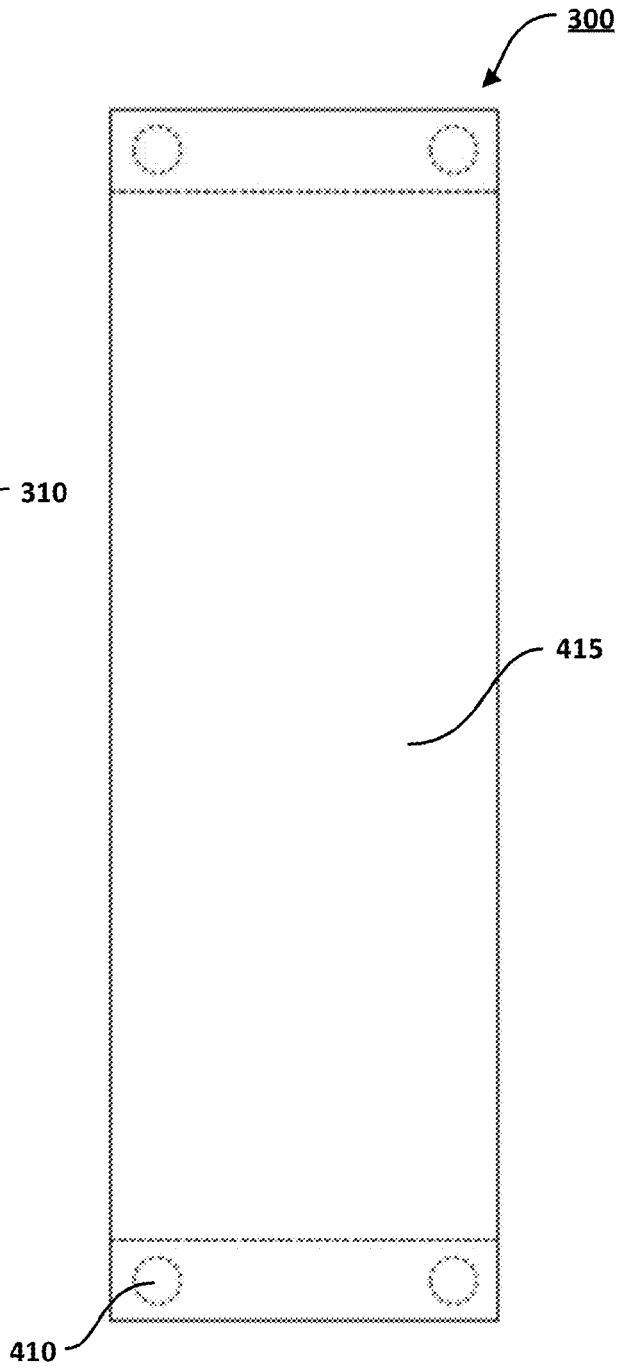
FIG. 4 is a diagram showing an embodiment of the lampshade cover, depicting the internal surface of the lampshade cover.

As depicted in FIG. 4, at least one fastener, a fastener 410, is attached to an internal surface 415 of the lampshade cover 300. The fastener 410 may be attached to the internal surface 415 with the use of any attachment procedure, such as sewing, gluing, or using magnets. The fastener 410 may be of any type of fastener, such as hook-and-loop, magnet, grommet, hook-and-eye, snap, fastener tape, and toggle. The fastener 410 may correspond to and may be able to bind with at least one fastener, the fastener 205, which may be attached to the internal surface 110 of the lampshade 100.

The lampshade cover 300 has a decoration 315 on an external surface 310 of the lampshade cover 300. As such, the decoration 315 may be of any color. In some embodiments, the decoration 315 may also be of any pattern, such as floral and striped. The lampshade cover 300 may be configured to encircle a lampshade of any shape, such as coolie, empire, bell, drum, oval, and square. The lampshade cover 300 may also be of any size. Further, in other embodiments, the lampshade cover 300 may be composed of any material such as plastic, metal, fabric, and paper. The lampshade cover 300 may be disposable. The lampshade cover 300 may also be transferable, and as such, may be taken off the lampshade 100 and may be put on another lampshade. In an exemplary embodiment, the lampshade cover 300 may also be reusable, and may be taken off the lampshade 100 for an extended period of time and placed back on the lampshade 100.

Figure 6:
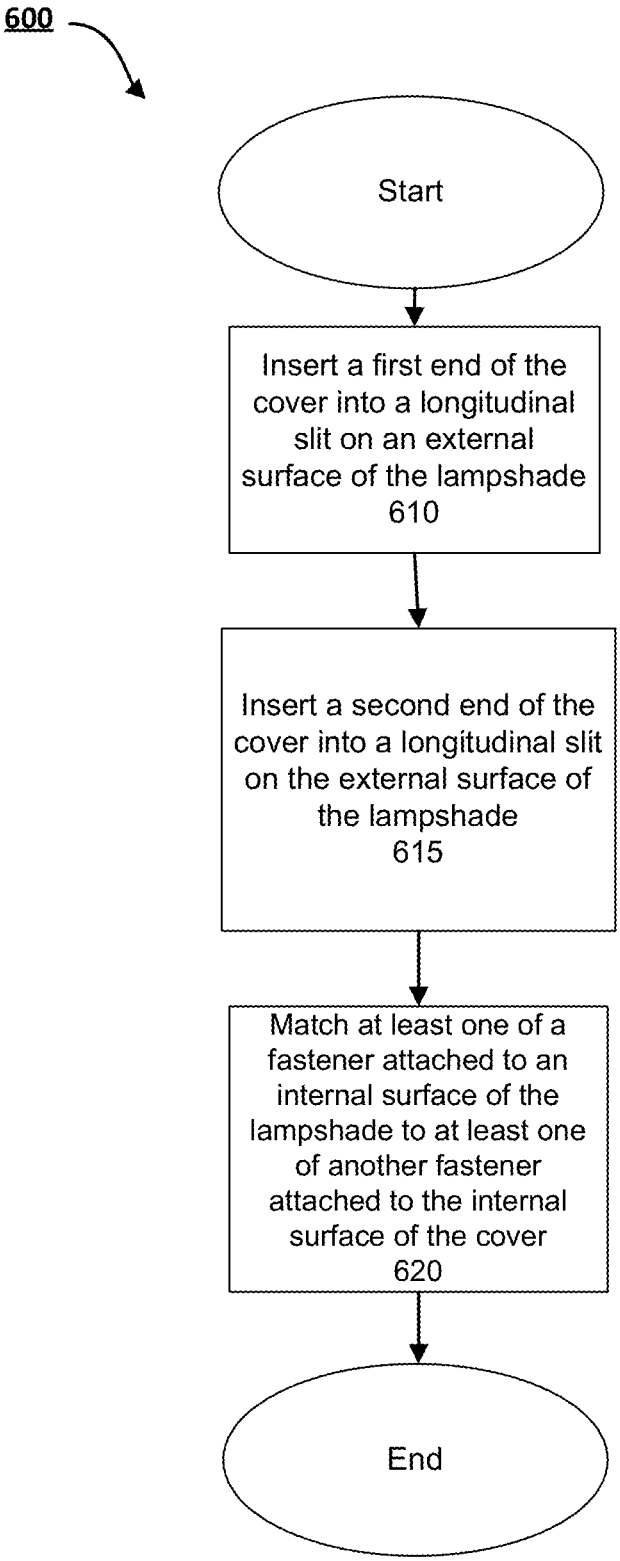
FIG. 6 is a flowchart of a method for applying a lampshade cover to a lampshade.

FIG. 6 illustrates a flowchart of an exemplary method 600 for applying the lampshade cover 300 to the lampshade 100. The lampshade cover 300 has two ends and a length that is between these two ends, a lampshade end 320 and a lampshade end 325.

The method 600 may include a step 610 of inserting the lampshade end 320 of the lampshade cover 300 into the longitudinal slit 115 on the external surface 105 of the lampshade 100. The method 600 may also include a step 615 of inserting the lampshade end 325 of the lampshade cover 300 into the longitudinal slit 115 on the external surface 105 of the lampshade 100. The lampshade cover 300 may then be pulled or stretched over the external surface 105 of the lampshade 100, causing the lampshade cover 300 to encircle the lampshade 100.

The method 600 may also include a step 620 of matching at least the fastener 205 attached to the internal surface 110 of the lampshade 100 to at least the fastener 410 attached to the internal surface 415 of lampshade cover 300. The lampshade cover 300 may be secured in its encirclement of the lampshade 100.

What is claimed is:

1. A lampshade comprising:

an external surface;

an internal surface;

at least one longitudinal slit on the external surface of the lampshade configured to receive both ends of at least one lampshade cover; and at least one lampshade fastener, the at least one lampshade fastener being affixed to the internal surface of the lampshade adjacent and parallel to the longitudinal slit and being configured to correspond and bind to a lampshade cover fastener.

2. The lampshade of claim 1 in which the longitudinal slit extends along the full length of the external surface of the lampshade.

3. The lampshade of claim 1 in which an upper seam binding is wrapped around a top of the lampshade.

4. The lampshade of claim 1 in which a lower seam binding is wrapped around a bottom of the lampshade.

5. The lampshade of claim 3 in which the longitudinal slit commences at a bottom of the upper seam binding.

6. The lampshade of claim 4 in which the longitudinal slit ends at a top of the lower seam binding.

7. The lampshade of claim 1 in which the lampshade is of a drum shape.

8. The lampshade of claim 1, in which the lampshade is composed of at least one of plastic, metal, fabric, and paper.

9. The lampshade of claim 1, in which the lampshade is fire-retardant.

10. The lampshade of claim 3, in which the upper seam binding is composed of at least one of rayon, silk, and cotton.

11. The lampshade of claim 4, in which the lower seam binding is composed of at least one of rayon, silk, and cotton.

12. The lampshade of claim 1, in which the at least one fastener is a hook-and-loop fastener.

13. A lampshade cover comprising:

a cover having an external surface comprising a decoration, the cover configured to enter a longitudinal slit on the external surface of a lampshade; and at least one lampshade cover fastener, the at least one lampshade cover fastener being affixed to an internal surface on at least one end of the cover that enters the longitudinal slit and being configured to correspond and bind to a lampshade fastener.

14. The lampshade cover of claim 13, in which the lampshade cover is composed of at least one of plastic, metal, fabric, and paper.

15. The lampshade cover of claim 13, in which the lampshade cover is configured to encircle a drum-shaped lampshade.

16. The lampshade cover of claim 13, in which the lampshade cover is fire-retardant.

17. The lampshade cover of claim 13, in which the fastener is a hook-and-loop fastener.

18. A method for applying a cover to a lampshade comprising:

inserting a first end of the cover into a longitudinal slit on an external surface of the lampshade;

inserting a second end of the cover into a longitudinal slit on the external surface of the lampshade; and matching at least one of a lampshade fastener attached to an internal surface of the lampshade adjacent and parallel to the longitudinal slit to at least one of a lampshade cover fastener attached to the internal surface on at least one end of the cover that is inserted into the longitudinal slit.

19. The method of claim 18, in which the first end of the cover and the second end of the cover are attached to the internal surface of the lampshade.

* * * * *